US009386813B2

(12) United States Patent
Nagao et al.

(10) Patent No.: US 9,386,813 B2
(45) Date of Patent: Jul. 12, 2016

(54) MASK

(75) Inventors: Shogo Nagao, Shizuoka (JP); Takahiro Yagi, Shizuoka (JP)

(73) Assignee: San-M Package Co., Ltd., Shimada, Shizuoka (JP)

( * ) Notice: Subject to any disclaimer, the term of this patent is extended or adjusted under 35 U.S.C. 154(b) by 184 days.

(21) Appl. No.: 13/313,696

(22) Filed: Dec. 7, 2011

(65) Prior Publication Data

US 2012/0199142 A1 Aug. 9, 2012

(30) Foreign Application Priority Data

Feb. 3, 2011 (JP) ..... 2011-021921

(51) Int. Cl.
*A41D 13/11* (2006.01)

(52) U.S. Cl.
CPC ..... *A41D 13/1115* (2013.01)

(58) Field of Classification Search
CPC ..... A41D 13/11; A41D 13/1115; A41D 13/1176; A62B 18/02; A62B 18/025
USPC ..... 128/206.12, 206.19, 206.17, 206.21, 128/206.28, 205.25, 205.27, 205.28, 128/205.29, 206.13
See application file for complete search history.

(56) References Cited

U.S. PATENT DOCUMENTS

| | | | | | |
|---|---|---|---|---|---|
| 1,987,922 | A * | 1/1935 | Blatt | 128/863 |
| 2,248,477 | A * | 7/1941 | Lombard | 128/205.25 |
| 3,017,335 | A * | 1/1962 | Wolfe, Jr. | 205/356 |
| 3,017,888 | A * | 1/1962 | Weiner | 607/104 |
| 3,049,121 | A * | 8/1962 | Brumfield et al. | 128/206.14 |
| 3,288,138 | A * | 11/1966 | Sachs | 128/863 |
| 3,664,335 | A * | 5/1972 | Boucher et al. | 128/206.19 |
| 4,084,585 | A * | 4/1978 | Venaleck | 128/206.13 |
| 4,419,993 | A * | 12/1983 | Petersen | 128/206.19 |
| 4,966,140 | A * | 10/1990 | Herzberg | 128/206.19 |
| 5,682,879 | A * | 11/1997 | Bowers | 128/206.19 |
| 5,954,055 | A | 9/1999 | Miyake | |
| 7,069,930 | B2 * | 7/2006 | Bostock et al. | 128/206.19 |
| 2009/0205666 | A1 * | 8/2009 | Bowen | 128/206.13 |

FOREIGN PATENT DOCUMENTS

| | | | |
|---|---|---|---|
| JP | 3664543 B2 | 6/2005 | |
| JP | 2006296486 A | 11/2006 | |
| JP | 2008-055035 A | 3/2008 | |
| JP | 2009-000200 A | 1/2009 | |
| JP | 3162028 U | 8/2010 | |
| JP | 2010-187901 A | 9/2010 | |
| JP | 2011-194067 A | 10/2011 | |
| WO | 2011/116173 A2 | 9/2011 | |
| WO | WO 2011/116173 A2 * | 9/2011 | A62B 18/02 |

OTHER PUBLICATIONS

Office Action for Japanese Application No. 2011-021921 dated Jun. 3, 2014.

* cited by examiner

*Primary Examiner* — Nicholas Woodall
*Assistant Examiner* — Camtu Nguyen
(74) *Attorney, Agent, or Firm* — Kilpatrick Townsend & Stockton LLP

(57) ABSTRACT

There is provided a mask that includes a mask body and two strings. The two strings hold the mask body at a predetermined position on the face of a wearer by being caught by both ears or the head of the wearer. Folded portions, which are adapted so as to be capable of rising and falling on the surface of the mask body coming into contact with the face of the wearer, are formed on both sides of the mask body.

9 Claims, 12 Drawing Sheets

MASK

CROSS-REFERENCE TO RELATED APPLICATION

This application claims priority under 35 USC 119 from Japanese Patent Application No. 2011-021921 filed on Feb. 3, 2011.

BACKGROUND

1. Technical Field

The present invention relates to a mask.

2. Related Art

As a disposable non-woven fabric mask, there is an annular non-woven fabric mask where for example, two non-woven fabrics, which overlap each other so that the left and right direction corresponds to the front and back direction, contain thermoplastic synthetic fibers or natural fibers and these non-woven fabrics are practically joined to each other at the front and back side edge portions thereof. The front side edge portion and a portion near the front side edge portion are formed so as to be capable of covering a required portion of the face of a wearer, and the back side edge portion and a portion near the back side edge portion are formed so as to be capable of being caught by the head of the wearer. A required range of the joint portion of the back side edge portion in a vertical direction extends backward as compared to the rest portion of the back side edge portion positioned above and below the required range, and the synthetic fibers contained in the two non-woven fabrics, of which inner peripheral surfaces face each other at the extending portion of the back side edge portion, are melted and solidified (Japanese Patent No. 3664543).

Further, as a disposable non-woven fabric mask, there is a disposable mask that includes a mask body 3 and a pair of ear catch portions 4 formed at both left and right sides of the mask body 3. The mask body 3 is formed by joining left and right non-woven fabric sheets 1 at substantially the middle portion of the mask body 3 by a joint edge 2 that has a substantially circular arc shape in the vertical direction. Heating sheets 5, which heat a heating target portion of the face of a wearer by the reaction heat of heating powder 24, are provided on the left and right non-woven sheets 1 (Japanese Patent Application Laid-Open (JP-A) No. 2009-000200).

Further, there also is a disposable mask which includes a mask part 12 that covers the mouth of a wearer when the mask is worn, and ear catch portions 13 and 14 that protrude from the left and right end portions 13*l*, 13*r*, 14*l*, and 14*r* of the mask part 12 and are caught by ears. The ear catch portions 13 and 14 include a narrow band-like non-woven fabric W joined to the mask part as a member separated from the mask part 12, and at least one elastic member F disposed along the longitudinal direction X of the non-woven fabric W (JP-A No. 2010-187901).

However, the non-woven fabric masks in the related art have a problem in that leakage of air from the vicinity of the nose of a wearer or the ears of the wearer is not sufficiently prevented.

Accordingly, forming a nose grip at a portion of a non-woven fabric mask corresponding to the nose of a wearer to improve adhesiveness between the non-woven fabric mask and the nose of the wearer has been investigated. Further, putting an iron core into the nose grip or forming the nose grip from an aluminum bar to improve the strength of the nose grip itself have also been examined. Furthermore, disposing urethane foam, a non-woven fabric sheet, a laminated non-woven fabric, or a film along the nose grip, applying an adhesive around the nose grip, or disposing an adhesive tape (double-sided tape) to improve adhesiveness between the nose grip and a nose have been attempted.

In addition, a method which reduces the stress concentration at both ends of the mask by forming the folded shape of a mask so that a gap is not formed between the face of a wearer and the middle portion of the mask when the wearer wears the mask has also been examined.

SUMMARY OF THE INVENTION

The invention has been made to solve a problem in a convention mask that leakage of air from the vicinity of the nose of a wearer or the ears of the wearer is not sufficiently prevented, and an object of the invention is to provide a mask that effectively prevents leakage of air from the vicinity of the nose or the ears of the wearer.

According to a first aspect of the invention, there is provided a mask that includes a mask body and two strings. The strings hold the mask body at a predetermined position on the face of a wearer by being caught by both ears or the head of the wearer. Folded portions, which are adapted so as to be capable of rising on the surface of the mask body coming into contact with the face of the wearer, are formed on both sides of the mask body.

According to a second aspect of the invention, in the mask according to the first aspect, each of the folded portions may be fixed to the mask body at three sides thereof except one side closest to a middle portion of the mask body, so that each of the folded portions is formed in a shape of a bag.

According to a third aspect of the invention, in the mask according to the first aspect, one or plural cuts may be formed at portions of the mask body, which are positioned outside the folded portions, toward the middle portion of the mask body.

According to a fourth aspect of the invention, in the mask according to the third aspect, the cut may be formed in a shape of a slit.

According to a fifth aspect of the invention, in the mask according to the third aspect, the cut may be formed in a V shape.

According to a sixth aspect of the invention, in the mask according to the third aspect, the cut may be formed in a U shape.

According to a seventh aspect of the invention, in the mask according to the first aspect, side edges of the mask body may be formed in a shape of a circular arc curved toward the middle portion of the mask body.

According to an eighth aspect of the invention, in the mask according to the first aspect, a nose grip, which is bendable along the bridge of the nose of the wearer when the wearer wears the mask, may be provided at an upper edge portion of the mask body.

BRIEF DESCRIPTION OF THE DRAWINGS

Exemplary embodiments of the present invention will be described in detail based on the following figures, wherein.

DETAILED DESCRIPTION OF THE INVENTION

1. First Embodiment

Figure 1B:
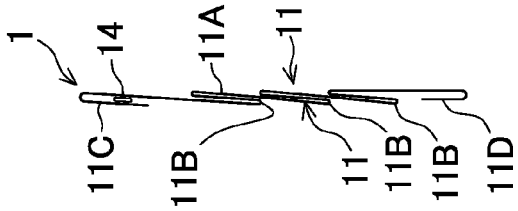
FIG. 1A is a front view of a mask according to a first embodiment as seen from the front side and FIG. 1B is a cross-sectional view of the mask showing a cross-section taken along a vertical plane X-X.
Figure 1A:
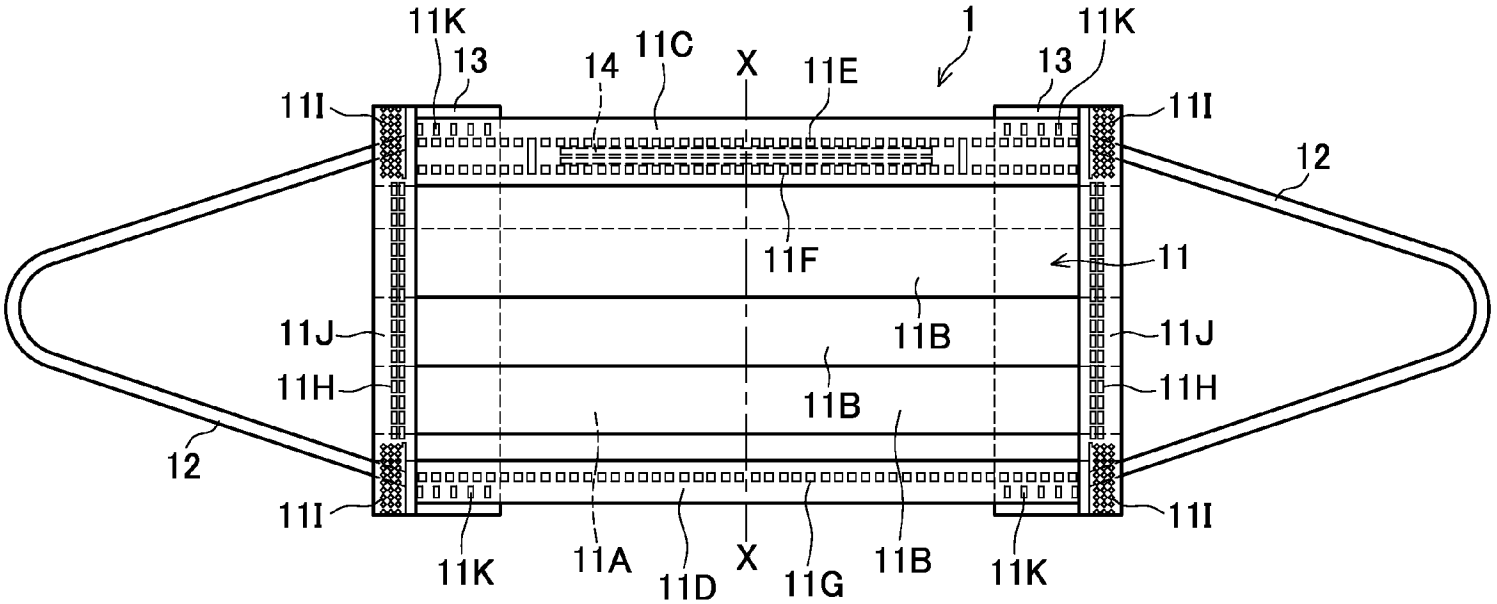

As shown in a front view of FIG. 1A and a vertical cross-sectional view of FIG. 1B, a mask 1 according to a first embodiment includes a mask body 11, two strings 12, and folded portions 13. The mask body 11 covers the nose and mouth of a wearer when the wearer wears the mask. The two strings 12 are provided on both sides of the mask body 11, and hold the mask body 11 at a predetermined position on the face of the wearer. The folded portions 13 are folded from both sides, that is, a pair of vertical edges of the mask body 11 toward the surface of the mask body 11, which comes into contact with the face of the wearer, that is, a back surface 11A; and are provided so as to be capable of rising and falling on the back surface 11A.

The mask body 11 is formed of, for example, three non-woven fabric sheets overlapping each other, and three horizontal pleats 11B, which are formed by folding the mask body so that the front side of the mask body is formed in ridges and the back side of the mask body is formed in grooves, are arranged from the top to the bottom.

An upper edge 11C of the mask body 11 is folded forward and bonded at melt bonding lines 11E and 11F. Likewise, a lower edge 11D of the mask body 11 is also folded forward and bonded at a melt bonding line 11G. A nose grip 14, which is formed of a flat square bar made of aluminum, is buried in the upper edge 11C between the melt bonding lines 11E and 11F.

Reinforcing bands 11J, which are made of a material selected from a non-woven fabric sheet, a laminated non-woven fabric, and a film, are bonded to both sides of the mask body 11 at melt bonding lines 11H while being folded from the front surface of the mask body 11 toward the back surface 11A. As a result, both side edge portions of the mask body 11 are formed. Portions of the reinforcing bands 11J, which are folded toward the back surface 11A, extend toward the middle portions of the mask body 11 and form the folded portions 13. One end of the string 12 and the other end of the string are bonded to the upper and lower ends of each reinforcing band 11J at portions 111. Meanwhile, the upper and lower edges of each folded portion 13 are bonded to the mask body 11 by the melt bonding lines 11K, so that the folded portion 13 is formed in a shape of a bag. However, the melt bonding lines 11K may be omitted so that the folded portion 13 is formed in a shape of a simple folded piece. Further, the folded portions 13 themselves may be omitted.

Figure 12:
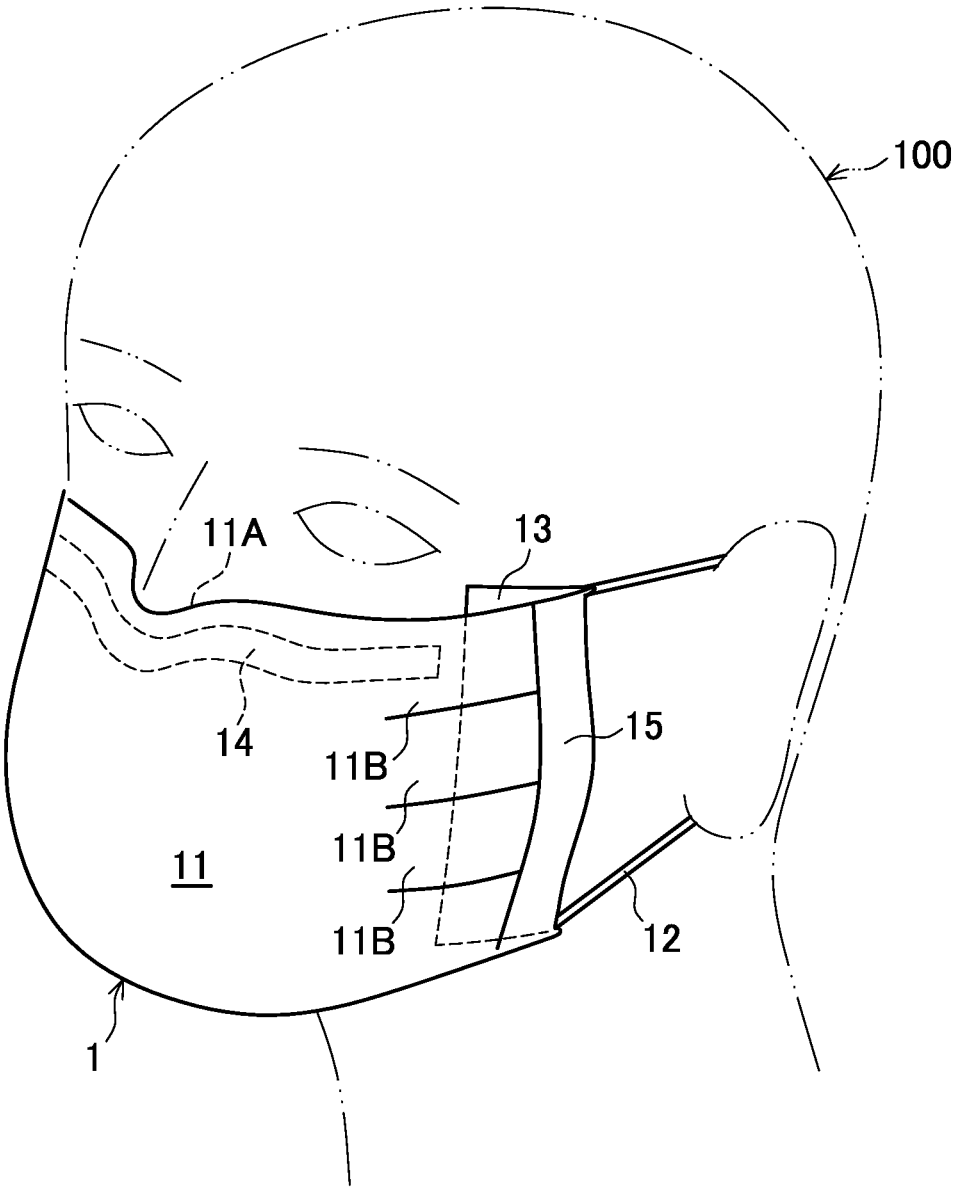
FIG. 12 is a perspective view of a wearer that wears the mask according to the first embodiment.

When a wearer 100 wears the mask 1, the respective two strings 12 of the mask 1 are caught by the ears of the wearer as shown in FIG. 12, the nose grip 14 is bent in a shape of a nose bridge so that the upper edge 11C of the mask body 11 comes into close contact with the face, and the folded portions 13 are folded so as to rise from the mask body 11.

When the wearer wears the mask 1, the pleats 11B of the mask body 11 are extended at the middle portion thereof. Accordingly, the nose and mouth of the wearer 100 are covered.

Meanwhile, forces, which cause both ends of both the sides of the mask body 11 to approach each other, are applied to both the sides of the mask body 11 by the tension applied from the strings 12, so that both the sides of the mask body 11 are bent outward from the face of the wearer 100. However, since forces, which allow the folded portions 13 to rise from the mask body 11, are applied to the folded portions 13 by the tension applied from the strings 12, gaps between both sides of the mask body 11 and the face of the wearer 100 are closed by the folded portions 13 that have risen. Accordingly, leakage of air from the ears of the wearer 100 is suppressed.

2. Second Embodiment

Figure 2B:
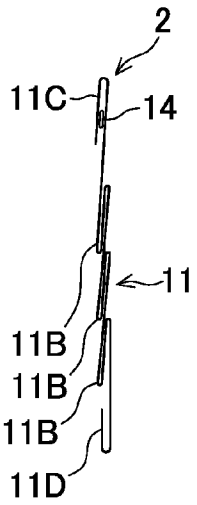
FIG. 2A is a front view of a mask according to a second embodiment as seen from the front side and FIG. 2B is a cross-sectional view of the mask showing a cross-section taken along a vertical plane X-X.
Figure 2A:
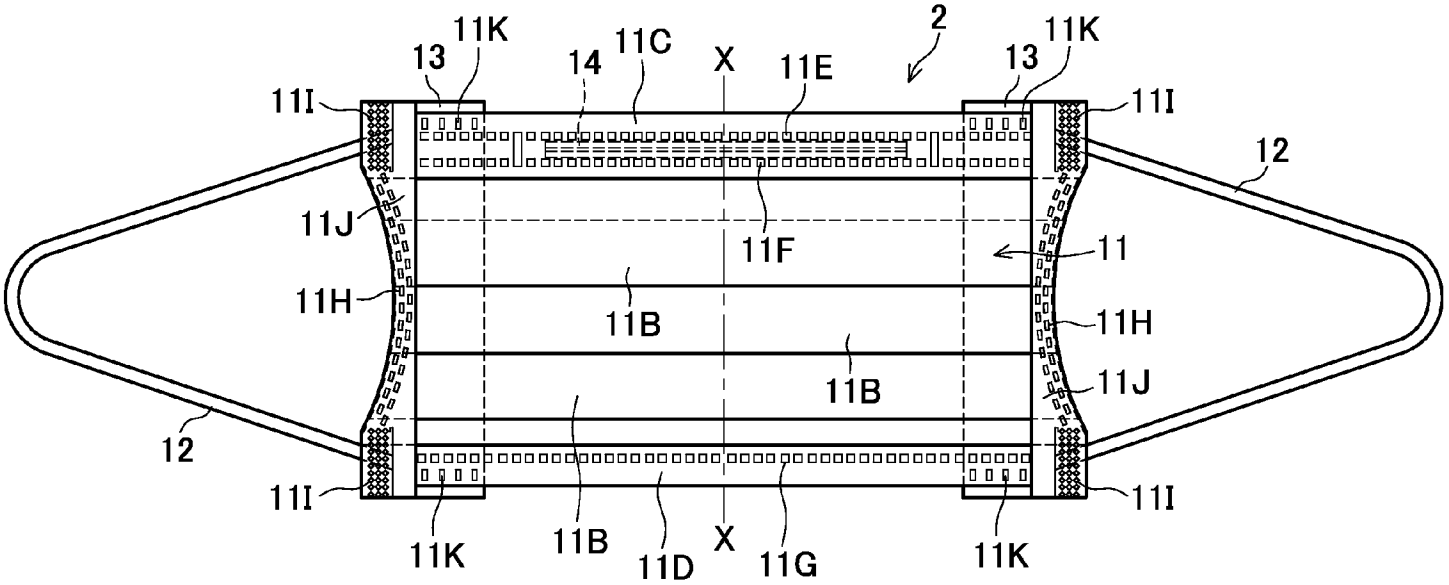
Figure 3B:
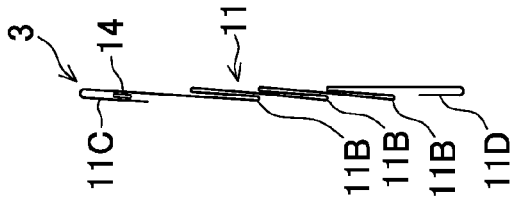
FIG. 3A is a front view of a first example of a mask according to a third embodiment as seen from the front side and FIG. 3B is a cross-sectional view of the mask showing a cross-section taken along a vertical plane X-X.
Figure 3A:
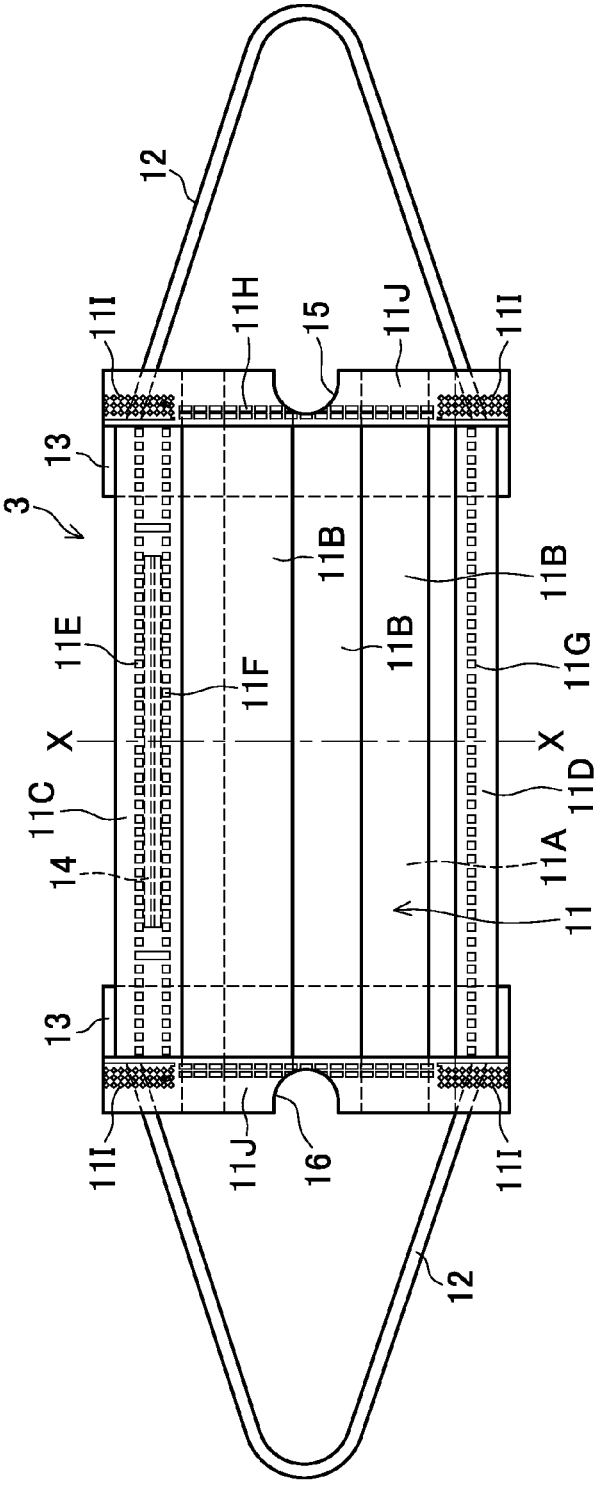
Figure 4B:
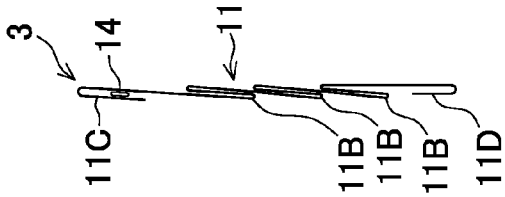
FIG. 4A is a front view of a second example of the mask according to the third embodiment as seen from the front side and FIG. 4B is a cross-sectional view of the mask showing a cross-section taken along a vertical plane X-X.
Figure 4A:
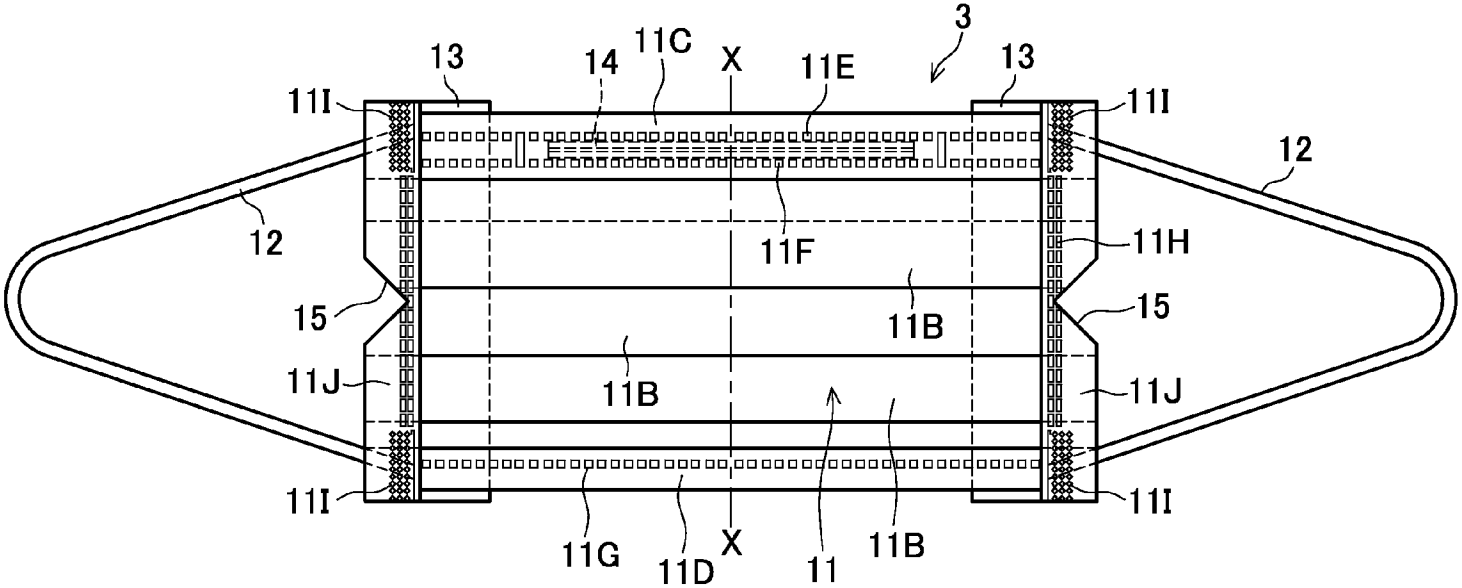
Figure 5B:
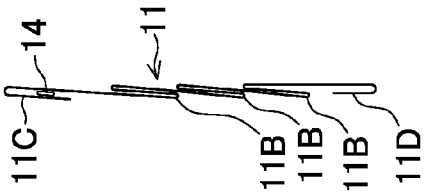
FIG. 5A is a front view of a third example of the mask according to the third embodiment as seen from the front side and FIG. 5B is a cross-sectional view of the mask showing a cross-section taken along a vertical plane X-X.
Figure 5A:
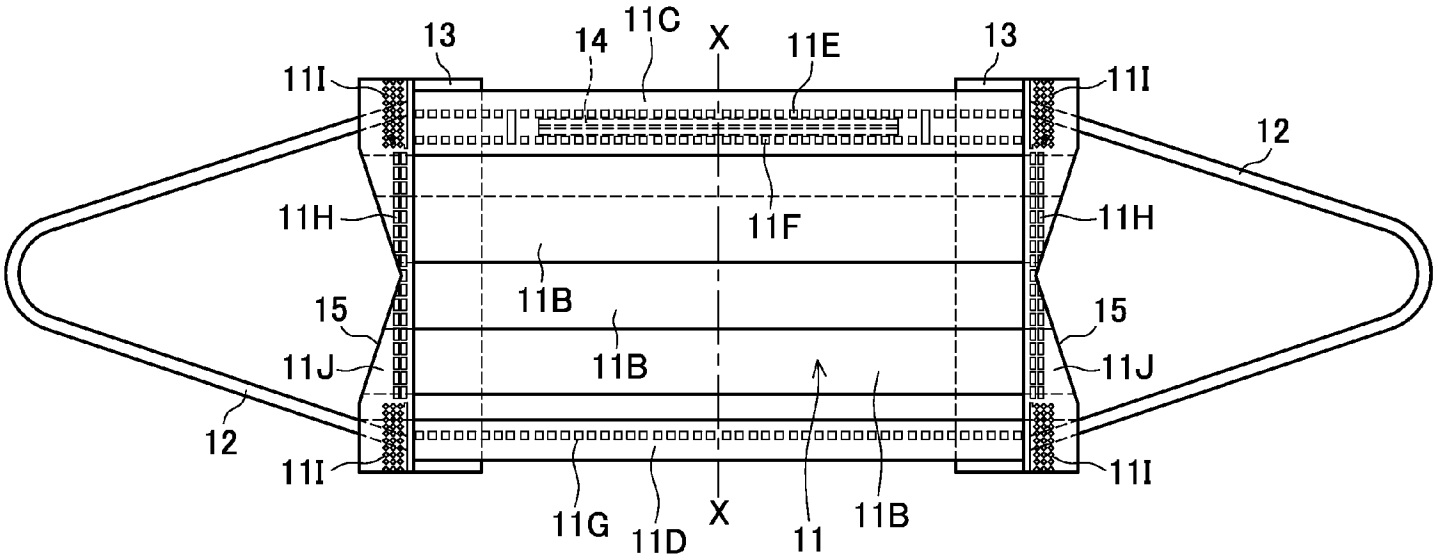
Figure 6B:
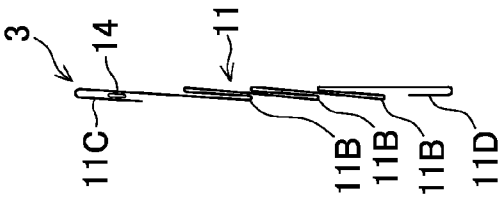
FIG. 6A is a front view of a fourth example of the mask according to the third embodiment as seen from the front side and FIG. 6B is a cross-sectional view of the mask showing a cross-section taken along a vertical plane X-X.
Figure 6A:
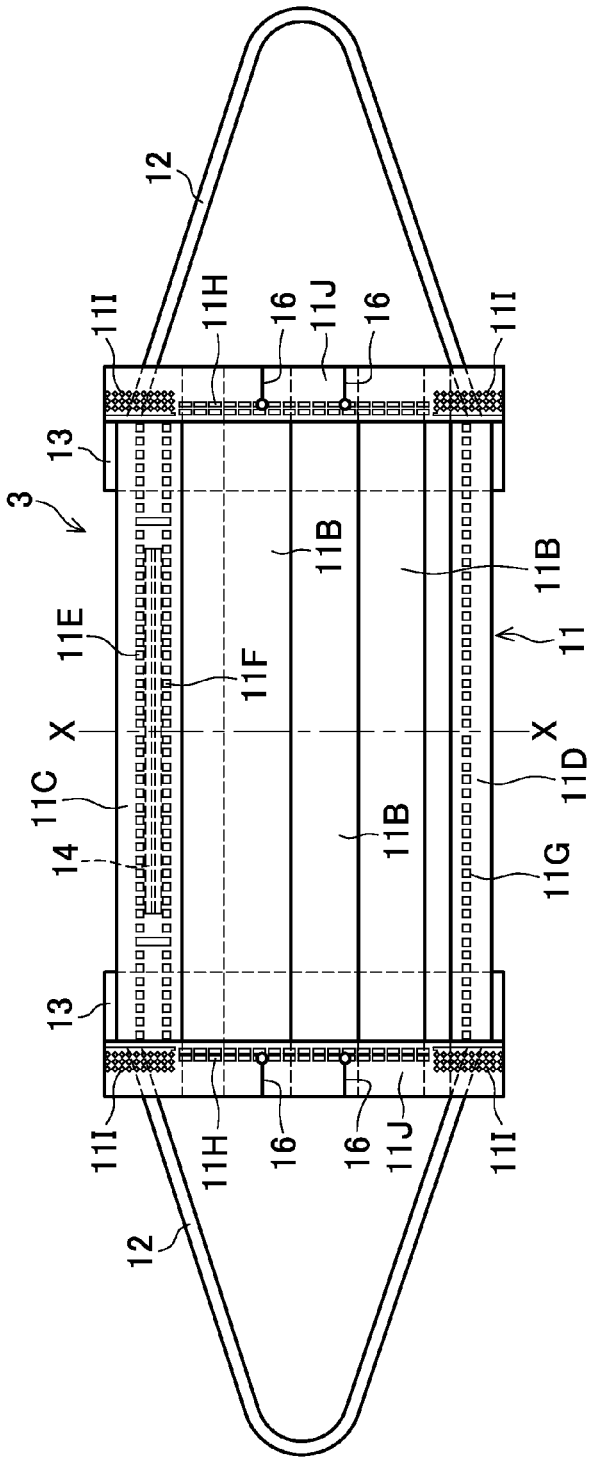

As shown in the front view of FIG. 2A and the vertical cross-sectional view of FIG. 2B, a mask 2 according to a second embodiment is obtained from the mask 1 according to the first embodiment by forming the melt bonding lines 11H, where the reinforcing bands 11J are bonded to both the side edges of the mask body 11, in a shape of a circular arc curved toward the middle portion of the mask body 11 and cutting the portions of the mask body 11, which are positioned outside the melt bonding lines 11H, along the melt bonding lines 11H so that both the side edges of the mask body 11 are formed in a shape of a circular arc curved toward the middle portion of the mask body 11. Meanwhile, in FIGS. 2 to 12, the same reference numerals as the reference numerals shown in FIG. 1 denote the same components as the components shown in FIG. 1.

The mask 2 according to the second embodiment has the same structure as the structure of the mask 1 according to the first embodiment except for the above-mentioned respect. Meanwhile, the folded portions 13 may be omitted in this embodiment. Further, even if the folded portions 13 are formed, the melt bonding lines 11K may be omitted so that the folded portions 13 are formed in a shape of a simple folded piece.

Since both the side edges of the mask body 11 are formed in a shape of a circular arc curved toward the middle portion of the mask body 11 in the mask 2 according to the second embodiment, floating of both the side edges of the mask body 11 from the face of the wearer 100, which is caused by the tension applied from the strings 12, is suppressed as compared to the mask 1 according to the first embodiment.

3. Third Embodiment

As shown in FIGS. 3 to 6, masks 3 according to a third embodiment is examples where U-shaped (FIG. 3) or V-shaped (FIGS. 4 and 5) cuts 15 are formed at the portions of the mask body 11 positioned outside the melt bonding lines 11H, that is, the portions of the mask body 11 positioned outside the folded portions 13 or slit-like cuts 16 (FIG. 6) are formed at the above-mentioned portions in the mask 1 according to the first embodiment.

The mask 3 according to the third embodiment has substantially the same structure as the structure of the mask 1 according to the first embodiment except for the above-mentioned respect, but the melt bonding lines 11K may be omitted. Meanwhile, the folded portions 13 may be omitted even in this embodiment.

Since cuts 15 or 16 are formed at the portions of the mask body 11 positioned outside the folded portions 13 in the mask 3 according to the third embodiment, the generation of stress at both the side edges of the mask body 11, which is caused by the tension applied from the strings 12 when a wearer wears the mask 3, is suppressed. Accordingly, floating of both the side edges of the mask body 11 from the face of the wearer 100 is suppressed more efficiently as compared to a mask that does not include the cuts 15 or 16.

4. Fourth Embodiment

Figure 7B:
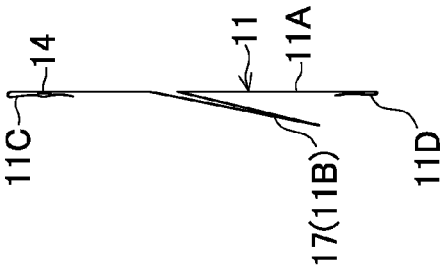
FIG. 7A is a front view of a mask according to a fourth embodiment as seen from the front side and FIG. 7B is a cross-sectional view of the mask showing a cross-section taken along a vertical plane X-X.
Figure 7A:
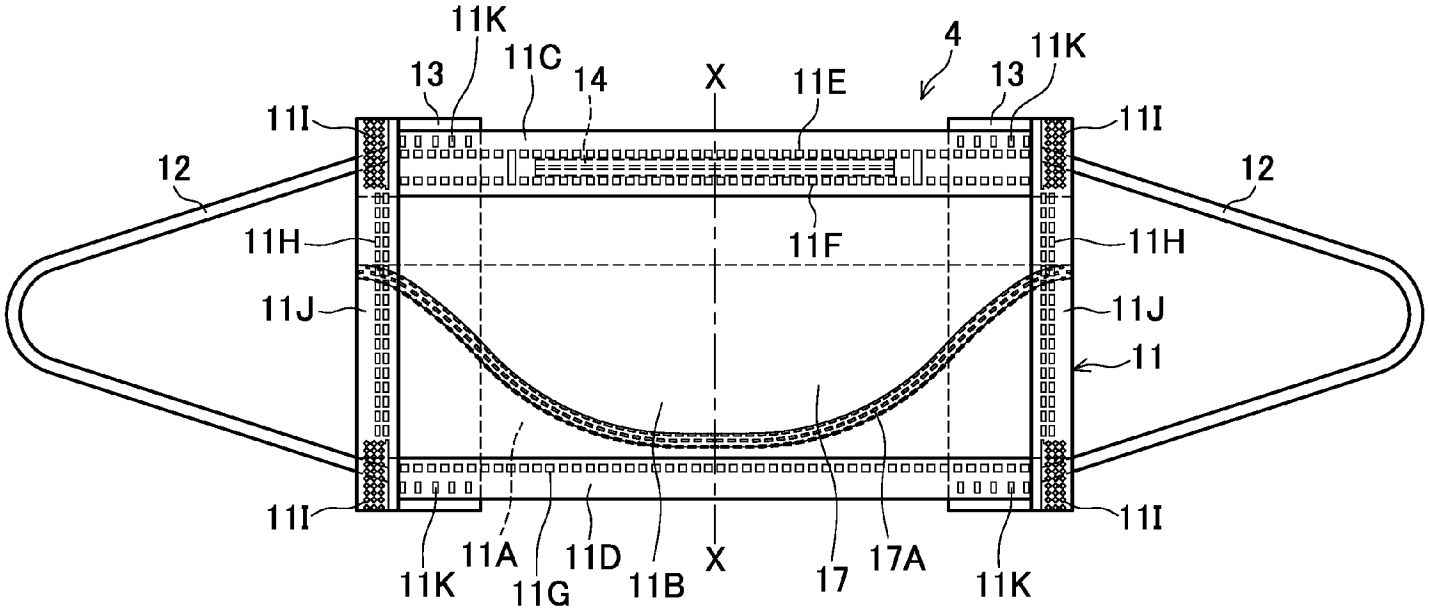

As shown in FIG. 7, in a mask 4 according to a fourth embodiment, a mask body 11 of is formed of, for example, three non-woven fabric sheets overlapping each other and one pleat 11B, which is formed by folding the mask body so that the front side of the mask body is formed into a ridge and the back side of the mask body is formed into a groove, is arranged in a horizontal direction. Further, the pleat is bonded by a melt bonding line 17A in a substantially U shape from both end portions of the pleat 11B toward the middle portions of the pleat. Further, the portion of the pleat positioned outside the melt bonding line 17A is cut along the melt bonding line 17A, so that a beak-shaped portion 17 having a shape of a bird's beak is formed. Accordingly, the mask 4 is referred to as a so-called bird-type mask.

The mask 4 has the structure described in the first embodiment except for the above-mentioned respect.

When wearing the mask 4, a wearer makes the folded portions 13 rise from the mask body 11 and spreads out the beak-shaped portion 17 from the back surface 11A in the vertical direction. Accordingly, the beak-shaped portion 17 protrudes forward in a shape of a bird's beak.

By wearing the mask 4 in this manner, gaps between the side edge portions of the mask body 11 and the face of the wearer are closed by the folded portions 13 and the nose and mouth of the wearer are almost completely covered with the beak-shaped portion 17.

5. Fifth Embodiment

Figure 8B:
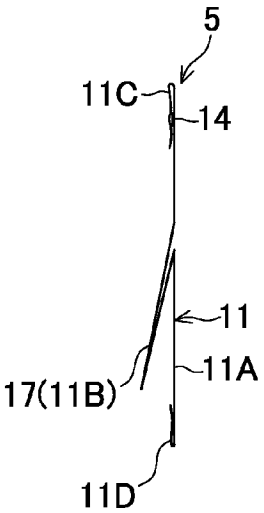
FIG. 8A is a front view of a mask according to a fifth embodiment as seen from the front side and FIG. 8B is a cross-sectional view of the mask showing a cross-section taken along a vertical plane X-X.
Figure 8A:
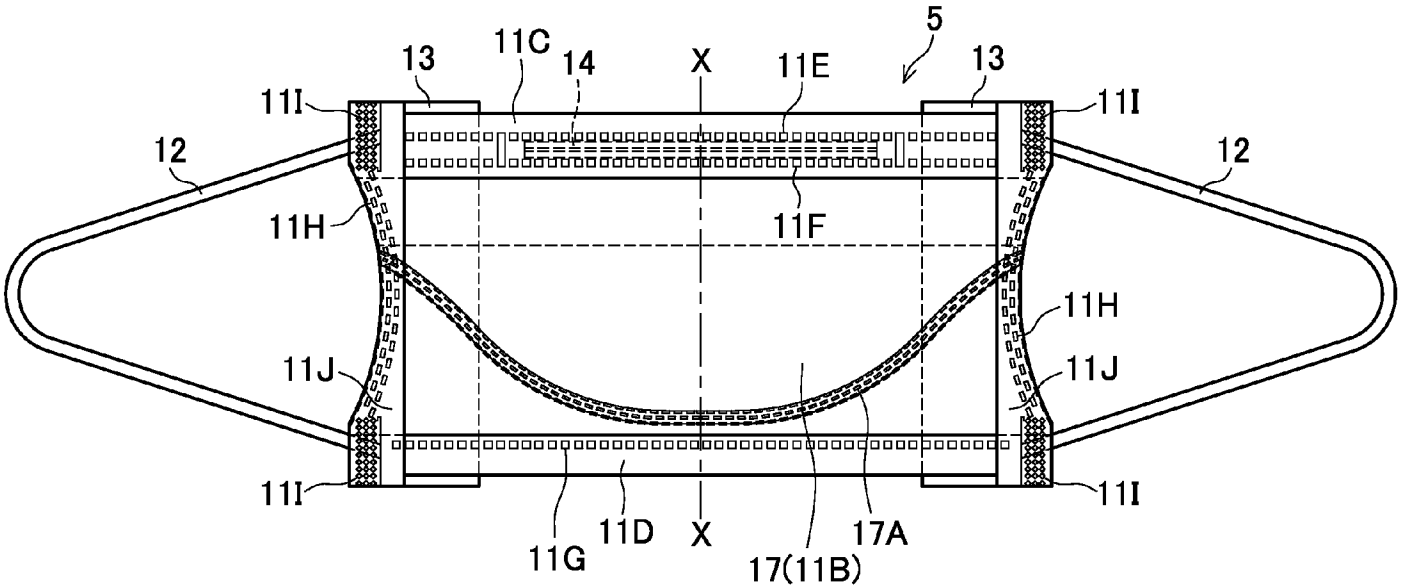

As shown in FIG. 8, a mask 5 according to a fifth embodiment is obtained from the mask 4 according to the fourth embodiment by forming the melt bonding lines 11H, where the reinforcing bands 11J are bonded to both the side edges of the mask body 11, in a shape of a circular arc curved toward the middle portion of the mask body 11 and cutting the portions of the mask body 11, which are positioned outside the melt bonding lines 11H, along the melt bonding lines 11H so that both the side edges of the mask body 11 are formed in a shape of a circular arc curved toward the middle portion of the mask body 11.

The mask 5 according to the fifth embodiment has the same structure as the structure of the mask 4 according to the fourth embodiment except for the above-mentioned respect. Meanwhile, the folded portions 13 may be omitted in this embodiment. Moreover, the melt bonding lines 11H may be formed in a "V" shape instead of the circular arc shape and the portions of the mask body 11, which are positioned outside the melt bonding lines 11H, may be cut along the melt bonding lines 11H so that both the side edges of the mask body 11 are formed in a V shape bent toward the middle portion of the mask body 11. Further, the folded portions 13 may be omitted even in this embodiment.

Since both the side edges of the mask body 11 are formed in a shape of a circular arc curved toward the middle portion of the mask body 11 in the mask 5 according to the fifth embodiment, floating of both the side edges of the mask body 11 from the face of the wearer 100, which is caused by the tension applied from the strings 12, is further effectively suppressed as compared to the mask 4 according to the fourth embodiment.

6. Sixth Embodiment

Figure 9B:
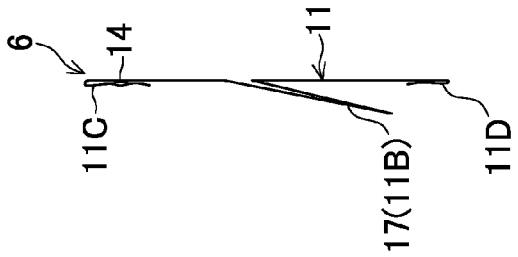
FIG. 9A is a front view of a mask according to a sixth embodiment as seen from the front side and FIG. 9B is a cross-sectional view of the mask showing a cross-section taken along a vertical plane X-X.
Figure 9A:
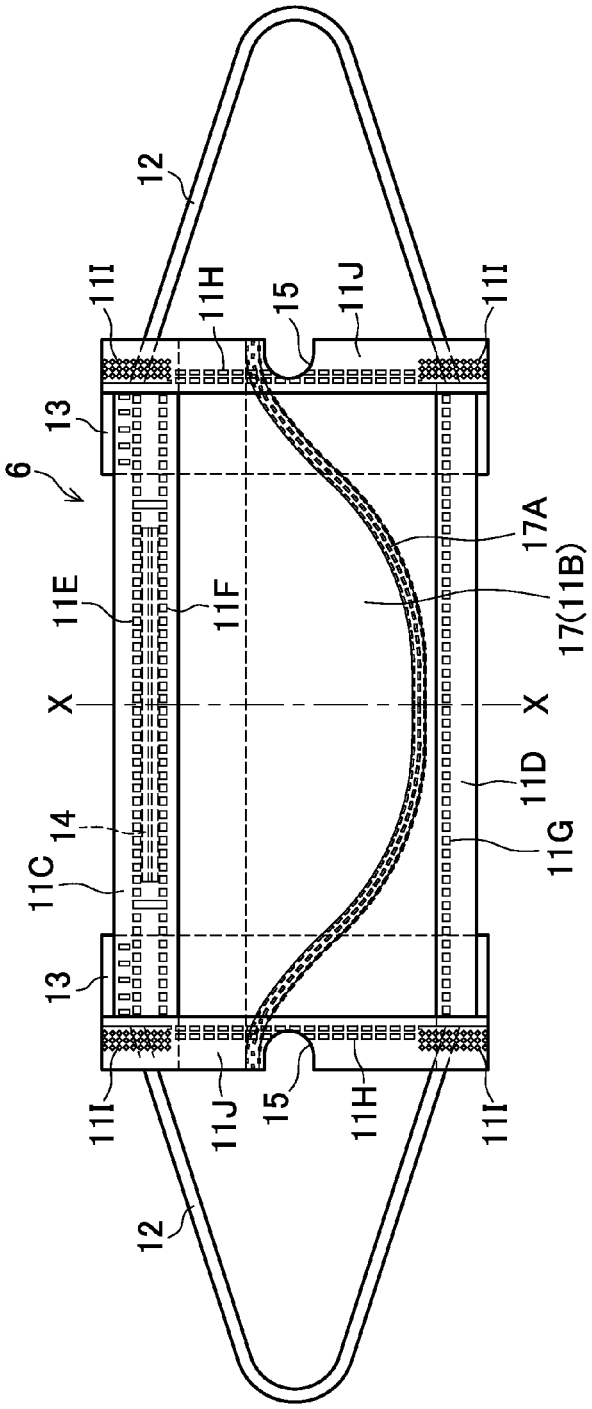

As shown in FIG. 9, a mask 6 according to a sixth embodiment is an example where U-shaped cuts 15 are formed at the portions of the mask body 11 positioned outside the melt bonding lines 11H, that is, the portions of the mask body 11 positioned outside the folded portions 13 in the mask 4 according to the fourth embodiment. The cut 15 can take a shape other than the U shape, for example, a V-shape or a shape of a slit. Meanwhile, the folded portions 13 may be omitted even in this embodiment.

The mask 6 according to the sixth embodiment has the same structure as the structure of the mask 4 according to the fourth embodiment except for the above-mentioned respect.

Since the cuts 15 are formed at the portions of the mask body 11 positioned outside the folded portions 13 in the mask 6 according to the sixth embodiment, the generation of stress at both the side edges of the mask body 11, which is caused by the tension applied from the strings 12 when a wearer wears the mask 6, is suppressed. Accordingly, floating of both the side edges of the mask body 11 from the face of the wearer 100, which is caused by the tension applied from the strings 12, is further effectively suppressed as compared to the mask 4 according to the fourth embodiment. Meanwhile, the folded portions 13 may be omitted even in this embodiment.

7. Seventh Embodiment

Figure 10B:
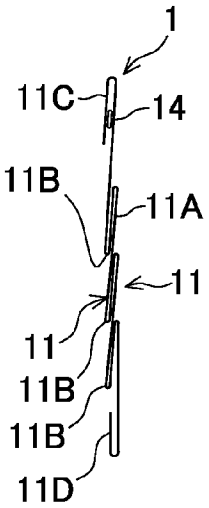
FIG. 10A is a front view of a mask according to a seventh embodiment as seen from the front side and FIG. 10B is a cross-sectional view of the mask showing a cross-section taken along a vertical plane X-X.
Figure 10A:
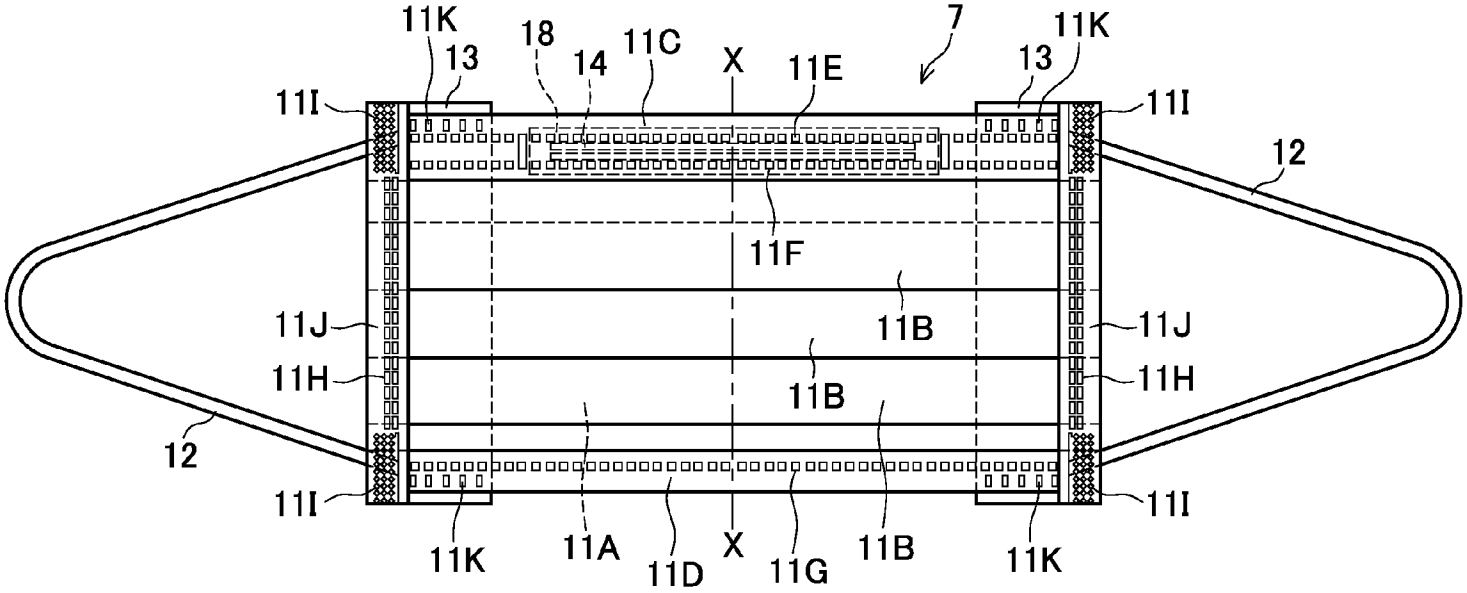
Figure 11:
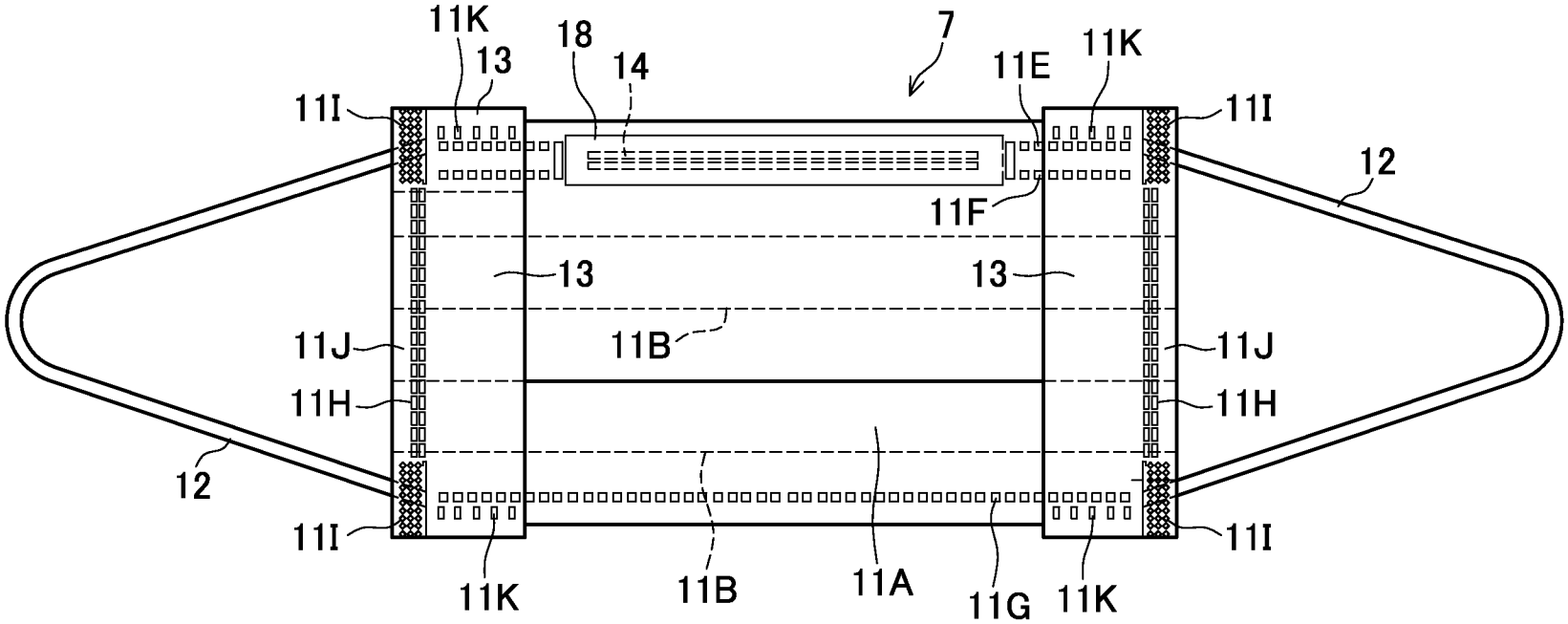
FIG. 11 is a back view of the mask according to the seventh embodiment as seen from the back side.

As shown in FIGS. 10 and 11, a mask 7 according to a seventh embodiment is an example where a nose pad portion 18 is adhered onto the back surface 11A of the mask body 11 along the nose grip 14 in the mask 1 according to the first embodiment.

The nose pad portion 18 is to improve closeness of the contact between the upper edge portion of the mask body 11 and the nose bridge of the wearer 100, and may be formed of urethane foam, a non-woven fabric sheet, a laminated non-woven fabric, a film, or the like. The nose pad portion 18 is attached to the back side of the nose grip 14 or attached to the mask body 11 over the entire width in the longitudinal (horizontal) direction of the mask body 11 so as to extend along the nose grip 14. Further, the nose pad portion 18 may be formed by applying a pressure sensitive adhesive or attaching a double-sided adhesive tape to the back surface 11A of the mask body 11 along the nose grip 14.

The mask 7 according to the seventh embodiment has the same structure as the structure of the mask 1 according to the first embodiment except for the above-mentioned respect. Meanwhile, the folded portions 13 may be omitted even in this embodiment.

Since the nose pad portion 18 is provided on the back surface 11A of the mask body 11 along the nose grip 14 in the mask 7 according to the seventh embodiment, closeness of the contact between the nose grip 14 of the mask body 11 and the nose bridge of the wearer 100 is improved as compared to a mask that does not include the nose pad portion 18.

What is claimed is:

1. A mask to be worn on a wearer's face, the mask comprising:

(i) a mask body;

(ii) two strings that hold the mask body at a predetermined position on the wearer's face by being hooked on both ears or the head of the wearer; and (iii) two folded portions, wherein one folded portion is attached to the left side and the other folded portion is attached to the right side of the mask body, with one edge of each folded portion extending toward a middle portion of the mask body;

wherein the folded portions are adapted to rise from the surface of the mask body that contacts the face of the wearer, when tension is applied to the strings, to close gaps between the face of the wearer and both sides of the mask body when the mask is worn by the wearer, and wherein each of the folded portions is fixed to the mask body at three sides of the folded portion, excluding one side that is closest to the middle portion of the mask body, so that each of the folded portions is formed in a shape of a bag.

2. The mask according to claim 1, wherein one or more incisions are formed in an outer side of each folded portion and extend toward the middle portion of the mask body.

3. The mask according to claim 2, wherein the one or more incisions are formed in a shape of a slit.

4. The mask according to claim 2, wherein the one or more incisions are formed in a V shape.

5. The mask according to claim 2, wherein the one or more incisions are formed in a U shape.

6. The mask according to claim 1, wherein the sides of the mask body are formed in a shape of a circular arc curved toward the middle portion of the mask body.

7. The mask according to claim 1, wherein a nose grip, which is bendable along a bridge of a nose of the wearer when the mask is worn, is provided at an upper edge portion of the mask body.

8. The mask according to claim 1, wherein a pleat is formed in a horizontal direction of the mask body by folding the mask body so that a front side of the mask body is formed into a ridge and a back side of the mask body is formed into a groove.

9. The mask according to claim 8, wherein the pleat is bonded by a bonding line in a substantial U shape extending from both sides toward the middle portion in the horizontal direction of the mask body.

* * * * *